US008365824B2

(12) United States Patent
Phillips

(10) Patent No.: US 8,365,824 B2
(45) Date of Patent: Feb. 5, 2013

(54) PERFORATING AND FRACTURING SYSTEM

(75) Inventor: James G. Phillips, Grapevine, TX (US)

(73) Assignee: Baker Hughes Incorporated, Houston, TX (US)

( * ) Notice: Subject to any disclaimer, the term of this patent is extended or adjusted under 35 U.S.C. 154(b) by 320 days.

(21) Appl. No.: 12/503,577

(22) Filed: Jul. 15, 2009

(65) Prior Publication Data

US 2011/0011643 A1 Jan. 20, 2011

(51) Int. Cl.
*E21B 43/11* (2006.01)
*E21B 43/1185* (2006.01)

(52) U.S. Cl. ..... 166/297; 166/63; 166/318; 175/4.55

(58) Field of Classification Search ..... 166/297, 166/299, 63, 318; 175/4.52, 4.55
See application file for complete search history.

(56) References Cited

U.S. PATENT DOCUMENTS

| | | | | |
|---|---|---|---|---|
| 2,120,615 | A * | 6/1938 | King | 175/4.55 |
| 3,130,784 | A * | 4/1964 | Pennington, II | 166/285 |
| 4,901,802 | A * | 2/1990 | George et al. | 175/4.52 |
| 5,067,568 | A * | 11/1991 | Yates et al. | 175/4.52 |
| 5,146,992 | A * | 9/1992 | Baugh | 166/383 |
| 5,215,148 | A | 6/1993 | Ricles | |
| 5,355,957 | A * | 10/1994 | Burleson et al. | 166/297 |
| 5,449,039 | A * | 9/1995 | Hartley et al. | 166/297 |
| 5,467,823 | A * | 11/1995 | Babour et al. | 166/250.01 |
| 5,603,384 | A | 2/1997 | Bethel et al. | |
| 5,660,232 | A * | 8/1997 | Reinhardt | 166/297 |
| 5,680,905 | A | 10/1997 | Green et al. | |
| 5,890,539 | A * | 4/1999 | Huber et al. | 166/297 |
| 6,536,524 | B1 * | 3/2003 | Snider | 166/297 |
| 2008/0053658 | A1 * | 3/2008 | Wesson et al. | 166/297 |

FOREIGN PATENT DOCUMENTS

EP 0256723 A2 2/1988

OTHER PUBLICATIONS

Simon P. Benavides, William D. Myers, Edgar W. Van Sickle and Kristian Vargervik (Baker Hughes Incorporated), Advances in Horizontal-Oriented Perforating Optimize Perforation Efficiency and Production While Maintaining Borehole Stability, SPE Production and Operations Symposium, Mar. 22-25, 2003, SPE 80929.

Simon P. Benavides, William D. Myers, Edgar W. Van Sickle and Kristian Vargervik (Baker Hughes Incorporated), "Advances in Horizontal Oriented Perforating", SPE Latin American Caribbean Petroleum Engineering Conference, Apr. 27-30, 2003, SPE 81051.

Simon P. Benavides, William D. Myers, Edgar W. Van Sickle and Kristian Vargervik (Baker Hughes Incorporated), "Advances in Horizontal Oriented Perforating Optimize Perforating and Production While Maintaining Borehole Stability" SPE Asia Pacific Oil and Gas Conference and Exhibition, Sep. 9-11, 2003, SPE 80443.

International Search Report and Written Opinion, Mailed Feb. 11, 2011; International Appln No. PCT/US2010/041052; International Search Report 5 Pages; Written Opinion 3 Pages.

* cited by examiner

*Primary Examiner* — David Bagnell
*Assistant Examiner* — Robert E Fuller
(74) *Attorney, Agent, or Firm* — Cantor Colburn LLP

(57) ABSTRACT

A system for use in borehole completion is provided and includes a perforating sub, a firing sub having a first port and an interior and including a firing assembly disposable within the interior and operably coupled to the perforating sub and a drilling fluid barrier, which is formed with a second port and is displaceable toward a position at which the first and second ports align to form a fluid path through the interior that is sufficiently pressurizable to actuate the firing assembly, a drop plug selectively engageable with the drilling fluid barrier to enable displacement thereof to the position in response to applied pressures and an isolation sub, into which the drop plug is receivable following disengagement thereof from the drilling fluid barrier.

17 Claims, 1 Drawing Sheet

PERFORATING AND FRACTURING SYSTEM

BACKGROUND

Perforation is well known in the downhole drilling and completion industry. Those of skill in the art are well familiar with "serf guns" that are run into a borehole to a selected depth and actuated to apply the energy of one or more shaped charges to perforate a casing or liner installed in the borehole.

Commonly, perforation guns use electrical signals from the surface to fire the guns. Alternative technologies allow the guns to be run by way of a mechanism on the gun that arms the charges upon reaching a selected temperature and/or pressure within the borehole. A timer can be added to fire them following a set interval. Perforation provides access to the formation for either production or treatment including frac treatments.

SUMMARY

According to an aspect of the invention, a system is provided and includes a perforating sub, a firing sub having a first port and an interior and including a firing assembly disposable within the interior and operably coupled to the perforating sub and a drilling fluid barrier, which is formed with a second port and is displaceable toward a position at which the first and second ports align to form a fluid path through the interior that is sufficiently pressurizable to actuate the firing assembly, a drop plug selectively engageable with the drilling fluid barrier to enable displacement thereof to the position in response to applied pressures and an isolation sub, into which the drop plug is receivable following disengagement thereof from the drilling fluid barrier.

According to another aspect of the invention, a firing sub for use in borehole completion is provided and includes a body formed with a first port and an interior, a firing assembly, including an igniter operably coupled to a perforating sub and a firing piston disposable in the interior and displaceable toward an operational position at which the firing piston abuts and thereby actuates the igniter, and a fluid pressure barrier, which is formed with a second port and is displaceable to a position at which the first and second ports align to form a fluid path through the interior that is sufficiently pressurizable to displace the firing piston to the operational position.

According to yet another aspect of the invention, a method for use in borehole completion is provided and includes associating a perforating sub and a firing sub with an isolation sub, conveying a perforating sub, a firing sub and an isolation sub downhole, dropping a drop plug downhole to cause the drop plug to engage with and displace a fluid pressure barrier of the firing sub, and pressuring up to cause the drop plug to disengage and to proceed downhole toward a plug position relative to the isolation sub.

BRIEF DESCRIPTION OF THE DRAWINGS

Referring now to the drawings wherein like elements are numbered alike in the several Figures.

DETAILED DESCRIPTION

Figure 1:
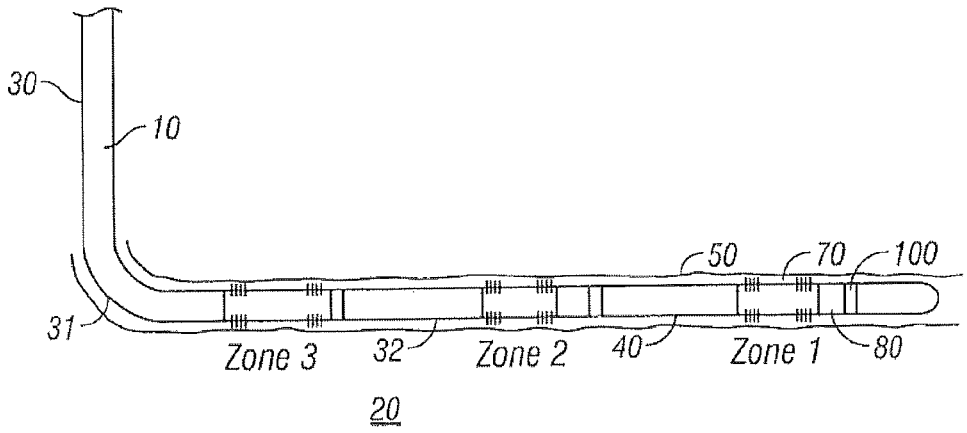
FIG. 1 is a sectional view of a borehole including multiple perforating zones.
Figure 2:
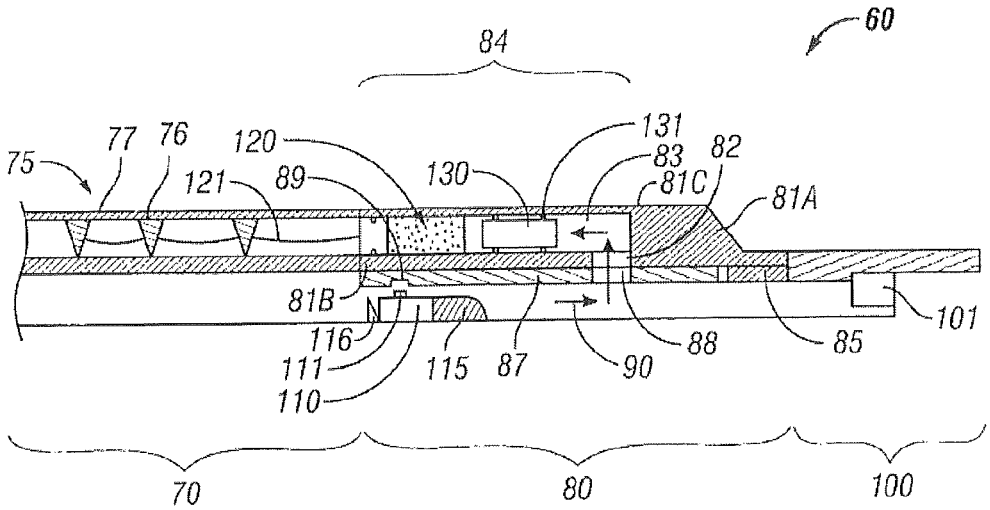
FIG. 2 is a sectional view of a perforating sub, a firing sub and an isolation sub for use in the borehole of FIG. 1.

With reference to FIGS. 1 and 2, a borehole 10 is illustrated in a formation 20. The formation, in some iterations may be a hydrocarbon bearing formation while in others may be one useful for example for Carbon Dioxide sequestration. The borehole 10, in one embodiment, includes a substantially vertical section 30 at an uphole portion thereof, a curved section 31 downhole from the substantially vertical section 30 and a substantially horizontal section 32 downhole from the curved section 31 although it is to be understood that this configuration is not required. The borehole 10 may be formed with an open hole configuration or with a casing 40 and/or a cemented liner 50. For brevity, the following discussion will relate to the casing 40 configuration although it is to be understood that this is not a limiting embodiment.

Completion of the borehole 10 is achieved in some cases by perforating and/or fracing operations. With reference to FIG. 2 and, in accordance with embodiments of the invention, a system 60 for use in borehole completion includes a perforating sub 70, a firing sub 80 and an isolation sub 100.

The perforating sub 70 includes charges 75 supported therein. The charges 75 may include an expendable communication device, such as a shape charge 76 or a pyrotechnic bolt, for example, that can be configured to hold pressure integrity for a previous fracture stage. When ignited, the charges 75 penetrate at least the outer wall 77, the casing 40 and at least a short depth into the cemented liner 50. In some cases, the charges 75 may be configured to penetrate into the formation 20 as well.

A length of the perforating sub 70, a number of the charges 75, an interval between the charges 75 and a shot density of each of the charges 75 may all be variable for a given application. For example, as shown in the exemplary configuration of FIG. 2, the perforating sub 70 may include 3 or more charges 75 separated from one another and from the igniter 120. In addition, while the charges 75 are shown as being perimetrically aligned, it is to be understood that the charges could also be arranged at varying perimetric positions around a central axis of the borehole 10.

The firing sub 80 is disposable to be substantially adjacent to the perforating sub 70 although this is not required. The firing sub includes a body 81 having a base 81A and inner and outer walls 81B and 81C extending therefrom. The inner wall 81B is formed to define a first port 82 and the inner and outer walls 81B and 81C delimit an interior 83, which is communicable with the first port 82. A firing assembly 84 is disposable within the interior 83 and operably coupled to the perforating sub 70.

The body 81 may include a shoulder 85 and a fluid pressure barrier, which may include for example a sleeve 87 although this is not required and it is understood that other configurations are possible. The sleeve 87 is formed with a second port 88 and a first mating part 89 and is movably connected to an interior diameter of the body 81. The sleeve 87 is displaceable from an initial position, at which a leading edge of the sleeve 87 is separated from a rear surface of the shoulder 85 and toward an open position (see FIG. 2), at which the leading edge of the sleeve 87 abuts the rear surface of the shoulder 85 and the first and second ports 82 and 88 align to form a fluid path 90. The fluid path 90 extends through the first and second ports 82 and 88 and the interior 83 and is sufficiently pressurizable to actuate the firing assembly 84 to operate the perforating sub 70.

A drop plug 110 including a second mating part 111 is introducible into the borehole 10 along with drilling fluid, such as mud, which is pressurized to force the drop plug 110 downhole. In one embodiment, the drop plug 110 may be torpedo shaped with a forward section 115, from which the second mating part 111 protrudes, and a substantially flat rear section 116. With the sleeve 87 positioned on an interior diameter of the body 81, the first and second mating parts 89 and 111 engage one another by the pressurized movement of the drop plug 110 to thereby displace the sleeve 87 toward the open position. At the open position, the first and second mating parts 89 and 111 disengage automatically or are forced to disengage by an increase in the drilling fluid pressure.

The isolation sub 100 is disposable downhole from the firing sub 80 and includes a drillable plug seat 101 that is receptive of the drop plug 110 following the disengagement of the first and second mating parts 89 and 111. With the drop plug 110 received, the isolation sub 100 isolates an active fracture stage, including the perforating sub 70, the firing sub 80 and, in some cases, additional perforating/firing sub pairs, from a previous fracture stage.

The firing assembly 84 of the firing sub 80 may include an igniter 120 and a firing piston 130. The igniter 120 is operably coupled to the charges 75 by for example wiring 121 (or some other type of fuse) and, when activated, performs an ignition sequence that ignites the charges 75. The igniter 120 may perform this ignition sequence following a delay having a sufficient duration to allow the drop plug 110 to displace the sleeves 87 of each of the firing subs 80 of the active stage.

The firing piston 130 is displaceable from an initial non-operational position within the interior 83 of the firing sub 80 and toward an operational position. The firing piston 130 may be secured in the non-operational position by a series of pins 131, which are breakable as a result of the fluid path 90 becoming flooded with drilling fluid at a selected pressure. The selected pressure may be the pressure of the drilling fluid required to pressure the drop plug 110 downhole or an increased pressure in which case the pins 131 are breakable only by a drilling fluid pressure that exceeds a pressure to move the drop plug 110 downhole. This way, premature activation of the firing assembly 84 can be prevented. Once the pins 131 are broken, the drilling fluid displaces the firing piston 130 toward the operational position where the firing piston 130 abuts and thereby actuates the igniter 120.

The system 60 can be installed in multiple sections of the borehole 10. As shown in FIG. 1, for example, the borehole 10 may be formed to include zones 1, 2 and 3. Here, each zone includes respective perforation, firing and isolation subs 70, 80 and 100. Alternatively, zones 1, 2 and 3 may be classified as being parts of a fracture stage in which each zone includes a respective perforation sub 70 and a respective firing sub 80. A single isolation sub 100 is then disposable downhole from the last-in-sequence firing sub 80 to delimit a border between fracture stages. Thus, each fracture stage may include multiple perforating and firing subs 70 and 80, with each being associated with a single isolation sub 100 and with each firing sub 80 being associated with a corresponding perforating sub 70.

In accordance with another aspect of the invention, a method for use in borehole 10 completion is provided and includes associating one or more perforating subs 70 with a corresponding number of firing subs 80 with an isolation sub 100 and conveying the perforating sub 70, the firing sub 80 and the isolation sub 100 downhole. A drop plug 110 is then dropped or pressured downhole to cause the drop plug 110 to engage with and displace a fluid pressure barrier or, for example, a sleeve 87 of the firing sub 80 toward an open position. At this point, drop plug 110 is pressured up to cause the drop plug 110 to disengage from the sleeve 87 and to continue to move downhole toward a plug position relative to the isolation sub 100.

With the sleeve 87 in the open position, a firing assembly 84 of the firing sub 80 may be automatically actuated by the presence of pressurized drilling fluid in the interior 83 of the firing sub. In other embodiments, the method may further include increasing the drilling fluid pressure within the borehole 10 to selectively actuate the firing assembly 84.

While one or more embodiments have been shown and described, modifications and substitutions may be made thereto without departing from the spirit and scope of the invention. Accordingly, it is to be understood that the present invention has been described by way of illustrations and not limitation.

The invention claimed is:

1. A system for use in borehole completion, the system comprising:

a perforating sub;

a firing sub having a first port and an interior and including a firing assembly disposable within the interior and operably coupled to the perforating sub and a fluid barrier, which is formed with a second port and is displaceable toward a position at which the first and second ports align to form a fluid path through the interior that is sufficiently pressurizable with fluid to actuate the firing assembly;

a drop plug selectively engageable with the fluid barrier to enable displacement thereof to the position in response to applied pressures; and an isolation sub, into which the drop plug is receivable following disengagement thereof from the fluid barrier.

2. The system according to claim 1, further comprising multiple perforating and firing subs.

3. The system according to claim 1, wherein a length of the perforating sub is variable.

4. The system according to claim 1, wherein a shot density of a charge of the perforating sub is variable.

5. The system according to claim 4, wherein the charge holds pressure integrity for a previous stage.

6. The system according to claim 4, wherein the charge comprises at least one of a shape charge and a pyrotechnic bolt.

7. The system according to claim 1, wherein the fluid barrier comprises a sleeve positioned on an interior diameter of the firing sub.

8. The system according to claim 7, wherein the sleeve and the drop plug each comprise a selectively engageable corresponding mating part.

9. The system according to claim 8, wherein the mating part of the drop plug exclusively mates with the mating part of the sleeve of the firing sub in an active stage.

10. The system according to claim 1, wherein the firing assembly comprises:

a time delayed igniter to perform an ignition sequence for operating the perforating sub following a delay; and a firing piston, which is displaceable to an operational position at which the firing piston abuts the igniter in response to fluid pressure applied to the firing piston when the first and second ports are aligned.

11. The system according to claim 10, wherein the delay is sufficient to allow the drop plug to displace respective fluid barriers of multiple firing subs.

12. The system according to claim 10, wherein the firing piston is disposed at an initial secured position from which the firing piston is displaceable.

13. The system according to claim 12, wherein the firing piston is secured at the initial secured position by pins.

14. A system for use in borehole completion, the system comprising:

a plurality of perforation subs;

a plurality of firing subs corresponding to the plurality of perforation subs, each firing sub including:

a body formed with a first port and an interior;

a firing assembly, including an igniter operably coupled to a perforating sub and a firing piston disposable in the interior and displaceable toward an operational position at which the firing piston abuts and thereby actuates the igniter; and a fluid pressure barrier, which is formed with a second port and is displaceable to a position at which the first and second ports align to form a fluid path through the interior that is sufficiently pressurizable to displace the firing piston to the operational position;

wherein the plurality of firing subs and the plurality of perforation subs are associated with a single isolation sub such that a fluid passage extends through each of the firing subs in the plurality and is terminated by the isolation sub when the isolation sub is in an isolated configuration, the fluid passage enabling fluid pressure to be communicated simultaneously to each of the firing subs in the plurality via the fluid paths.

15. The system according to claim 14, comprising a drop plug selectively engageable with and disengageable from the fluid pressure barriers of each firing sub to enable displacement thereof respectively to the positions at which respective ones of the first and second ports align.

16. A method for use in borehole completion, the method comprising:

conveying a plurality of perforating subs, a plurality of firing subs, and an isolation sub downhole, each of the perforating subs corresponding to one of the firing subs;

dropping a drop plug downhole to cause the drop plug to engage with the plurality of firing subs; and pressuring up to cause the drop plug to successively engage with, displace, and then disengage from a fluid pressure barrier of each of the firing subs;

engaging the drop plug with the isolation sub in order to isolate the plurality of firing subs; and communicating fluid pressure simultaneously to each of firing subs in the plurality via a fluid path that extends through each of the firing subs and terminates at the isolation sub when the isolation sub is engaged with the drop plug.

17. The method according to claim 16, further comprising increasing the fluid pressure to actuate a firing assembly of each of the firing subs.

* * * * *